US009161607B2

(12) United States Patent
Choi

(10) Patent No.: US 9,161,607 B2
(45) Date of Patent: Oct. 20, 2015

(54) FORM FOR HOLDING OR STORING WIG, HAIR PIECE, OR HAIR EXTENSION

(75) Inventor: Kyung Ja Kay Choi, Great Neck, NY (US)

(73) Assignee: Hair Zone, Inc., Moonachie, NJ (US)

( * ) Notice: Subject to any disclaimer, the term of this patent is extended or adjusted under 35 U.S.C. 154(b) by 1041 days.

(21) Appl. No.: 12/653,071

(22) Filed: Dec. 8, 2009

(65) Prior Publication Data

US 2011/0132942 A1 Jun. 9, 2011

(51) Int. Cl.
*A45D 44/14* (2006.01)

(52) U.S. Cl.
CPC ..... *A45D 44/14* (2013.01)

(58) Field of Classification Search
USPC ..... 223/24, 25, 120, 1, 26, 66; 211/33; 132/54–55, 201, 53, 56
See application file for complete search history.

(56) References Cited

U.S. PATENT DOCUMENTS

| | | | | | |
|---|---|---|---|---|---|
| 1,224,427 | A | * | 5/1917 | Stevens | 223/24 |
| 1,240,104 | A | | 9/1917 | Tiffany | |
| 1,375,381 | A | * | 4/1921 | Golden | 132/274 |
| 2,298,602 | A | * | 10/1942 | Varon | 223/24 |
| 2,483,490 | A | | 10/1949 | Dix | |
| 3,158,335 | A | | 11/1964 | Deussen | |
| 3,188,752 | A | * | 6/1965 | Skinner | 34/104 |
| 3,254,757 | A | | 6/1966 | Raskin | |
| 3,312,439 | A | * | 4/1967 | Swee et al. | 248/176.1 |
| 3,658,174 | A | * | 4/1972 | Friedman | 206/8 |
| D226,246 | S | | 1/1973 | Duecker et al. | |
| 3,709,407 | A | | 1/1973 | Sanford | |
| 3,713,566 | A | | 1/1973 | Perez | |
| 3,779,433 | A | * | 12/1973 | Imai | 223/66 |
| 3,843,031 | A | * | 10/1974 | Oh et al. | 223/66 |
| 3,934,804 | A | * | 1/1976 | Bruce | 248/229.15 |
| 4,422,230 | A | * | 12/1983 | Nemoto | 29/434 |
| 4,998,992 | A | | 3/1991 | Richlin et al. | |
| 6,182,921 | B1 | | 2/2001 | Muylle et al. | |
| 2009/0289088 | A1 | * | 11/2009 | Choi | 223/84 |
| 2012/0006696 | A1 | | 1/2012 | Choi | |

* cited by examiner

*Primary Examiner* — Shaun R Hurley
*Assistant Examiner* — Andrew W Sutton
(74) *Attorney, Agent, or Firm* — Venable LLP

(57) ABSTRACT

An exemplary embodiment providing one or more improvements includes an form which holds a hair extension and maintains the order and curl of the strands of hair. The form provides optimum display of the wig or hair extension evaluation by the prospective user. In addition, after purchase, the form provides a means for convenient space-saving storage of the hair extension which maintains the appearance of the hair extension.

19 Claims, 5 Drawing Sheets

FORM FOR HOLDING OR STORING WIG, HAIR PIECE, OR HAIR EXTENSION

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO A "SEQUENCE LISTING," A TABLE, OR A COMPUTER PROGRAM LISTING APPENDIX

Not Applicable.

BACKGROUND

This application relates to apparatus and methods for storage of wigs or hair pieces.

BACKGROUND

Description of Related Art Including Information Disclosed Under 37 CFR 1.97 and 37 CFR 1.98.

Embodiments include forms which are used to hold wigs and hair pieces, including hair extensions, for display in a retail environment, and for storage by the user after purchasing. Embodiments have provisions to preserve the original order and curve of the strands of hair, of particular importance when human hair is used in hair extensions.

Embodiments of the present disclosure are a form for wigs, hair pieces or hair extensions in two parts, a form body and a form plug. Embodiment forms are used to hold and display wigs, hair pieces or hair extensions before retail sale, and after sale, to store such hair enhancements under conditions which maintain the order and curl of the hair strands.

U.S. Pat. No. 1,240,104 discloses a cone shaped yarn mass support with a circular protector on the tip.

U.S. Pat. No. 2,483,490 discloses a cone shaped yarn frusto-conical package support with a convexed bottom surface.

U.S. Pat. No. 3,158,335 discloses a conical winding core for textile yarn with end grooves.

U.S. Pat. No. 3,254,757 discloses a polystyrene foam molded hat support.

U.S. Pat. No. 3,709,407 discloses a wig form which includes a cone base which extends into the hollow neck portion of the housing.

U.S. Pat. No. 3,713,566 discloses a wig stand which collapses without an attached wig.

U.S. Pat. No. 4,998,992 discloses a wig stand made of compressible, open cell foam, which has channels used to ventilate the area under a wig.

U.S. Pat. No. 6,182,921 discloses a core used to wind strip material with a removable flange at one end.

U.S. Pat. No. D226,246 discloses a wig drier with an apparent rim about a hemispheric top.

U.S. patent application Ser. No. 12/154,037, filed May 20, 2008, and U.S. patent application Ser. No. 12/456,301, filed Jun. 15, 2009, each incorporated herein by reference, disclose a wig or hair piece box and form. The form has the general shape of a user's head.

None of the discovered prior art provide the advantages of embodiments of the present disclosure, for example, the advantages of an inexpensive form which is functional in storing and preserving the desirable characteristics of a wig, hair piece, or hair extension.

The foregoing examples of the related art and limitations related therewith are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

Embodiments include a form for holding and storing wigs, hair pieces, and hair extensions comprising a body comprising: a disk-shaped body top, a neck, a jar-shaped bolus, the neck connected to a bottom of the disk-shaped body top at one end and the neck connected to the top of the bolus at the other end, the bolus having a cone-shaped cavity in the bottom of the bolus. Also included is a plug having the shape of a truncated cone, the plug sized to fit into the cavity with an annulus between the sides of the plug and the surface of the cavity.

Embodiments include the process of placing a wig, hair piece or hair extension having curved parallel weft strands attached to a weft track on a form comprising the steps, obtaining a form comprising a body comprising a disk-shaped body top, a neck, a jar-shaped bolus, the neck connected to a bottom of the disk-shaped body top at one end and the neck connected to the top of the bolus at the other end, the bolus having a cone-shaped cavity in the bottom of the bolus, and a plug having the shape of a truncated cone, the plug sized to fit into the cavity with an annulus between the sides of the plug and the surface of the cavity, attaching the wig, hair piece or hair extension weft track to the neck, wrapping the weft track about the neck so that the curved parallel weft strands cover the surface of the bolus, inserting the free ends of the weft strands into the cavity, inserting the plug into the cavity and enclosing the form and wig, hair piece or hair extension with a hairnet.

In addition to the exemplary aspects and embodiments described above, further aspects and embodiments will become apparent by reference to the drawings and by study of the following descriptions.

DETAILED DESCRIPTION

In this disclosure the term "wig" means an easily detachable manufactured covering of natural or synthetic hair for the head. The term "hair piece" means natural or synthetic hair which is either woven to a user's natural hair for long term use or detachable attachment for short term use, commonly termed a weave or hair extension. The term "weft" means a collection of multiple strands of natural or synthetic hair, attached together by intricate stitched work with a sewing machine or fused together by glue and woven material, which is treated as a unit in the manufacture and styling or making of a wig or hair piece. The term "weft track" means a flexible, elongated strip, stitched or fused in section, to which wefts or strands of hair are attached. The term "root end" means the end of hair which is stitched or fused together to the weft track, which is to be attached to the wig supporting fabric or base cap, or to the user's natural hair in the case of a hair piece. The term "tip end" means the opposite ends of the strands of hair or weft which is not attached to the wig or hair piece supporting fabric or base cap or to user's natural hair.

Figure 1:
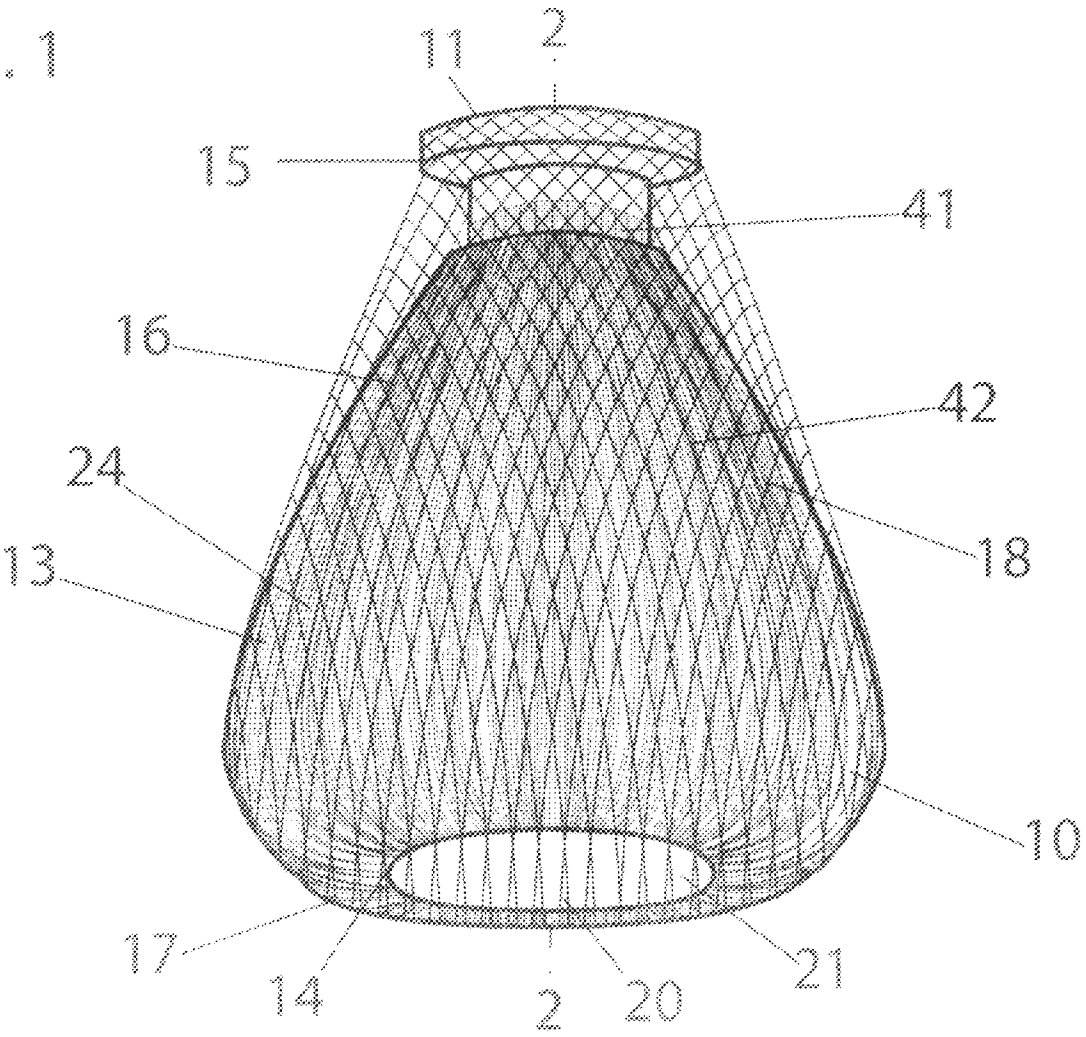
FIG. 1 is a perspective view of an embodiment form holding a hair extension showing a plug and covering hairnet.

FIG. 1 is a perspective view of an embodiment form holding a hair extension extending over the form body with a form plug and a covering hairnet. Visible in FIG. 1 is a form 10 comprised of a form body 13 and a form plug 20. Visible in FIG. 1 is the disk-shaped body top 11 and the bolus 24 of the form body. The form in FIG. 1 supports and is covered by a wig, hair piece or hair extension 16. Visible in FIG. 1. is a weft track 41 wrapped about the body neck (not visible in FIG. 1) the weft track with attached wefts or strands 42 of hair which extend over and cover the jar-shaped bolus 24, the wefts or strands 42 curve over the curved bottom 17 of the bolus 24, and the wefts or strands 42 extend into a cavity 14 at the bottom 17 of the bolus 24. The wefts or strands 42 of hair are retained in the cavity by a cone-shaped plug 20 whose base 21 is visible in FIG. 1. A removable hairnet 18 covers the entire form and retains the hair extension 16 and plug 20 in place.

Figure 2:
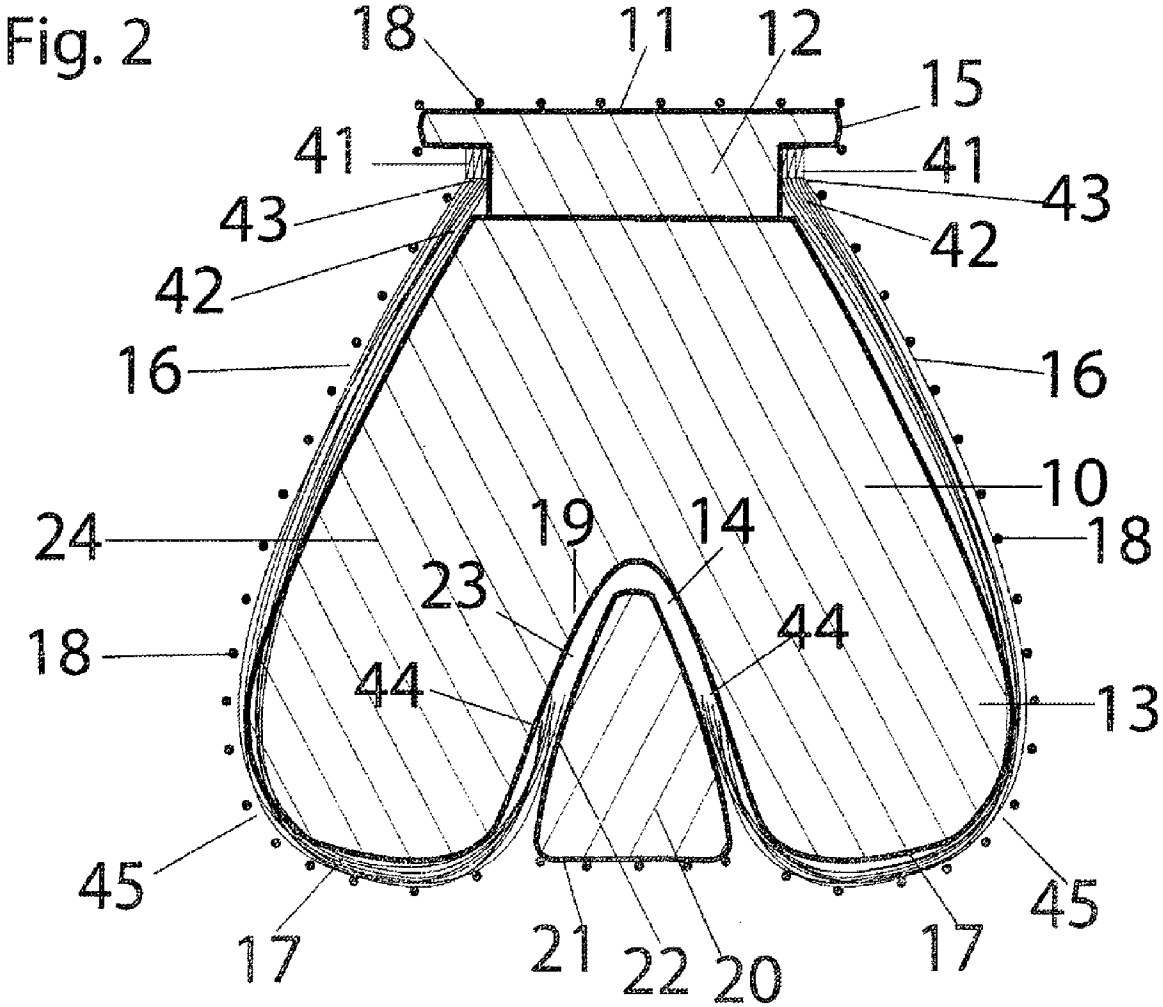
FIG. 2 is a cross-section view of an embodiment form of FIG. 1 taken at line 2-2.

FIG. 2 is a cross-section view of an embodiment form of FIG. 1 taken at line 2-2. The form 10 is comprised of the form body 13 and form plug 20. Visible in FIG. 2 is the disk-shaped body top 11 with flange 15, which is attached to the body neck 12, which is attached to the body jar-shaped bolus 24. Also visible is the curved bottom 17 of the bolus 24, and cone-shaped cavity 14 in the bottom of the bolus. A truncated cone-shaped plug 20 is shown inserted in the cavity 14. An annulus 23 is formed between the sides 22 of the plug and the interior wall 19 of the cavity 14.

A hair extension 16 is shown attached to the form. The weft track 41 of the hair extension 16 is shown wrapped about the neck 12. Some layers of a single wrapped hair extension weft track 41 are shown. The end of the weft track is removably secured to the neck by a fastener, in this example, a straight pin (not shown). Pins are used to secure the wrapped track as necessary as it is wrapped about the neck. The weft or strands 42 of hair attached to the weft track 41 are visible. For purposes of clarity, in FIG. 2 only one hair strand is shown which represents the 10-50 strands in a typical weft 42. The weft or hair strands 42 are attached to the weft track 41 at the root tip 43. The curve of the curved weft shaft 45 conforms to the curved bottom 17 of the bolus 24. The free tip 44 of the weft or hair strand 42 extends into the cavity 14 of the bolus 24 and is retained in the annulus 23 between the inner surface 19 of the cavity 14 and the plug sides 22 of the cone-shaped plug 20. The weft or strands 42 are arrayed substantially parallel to each other and extend centrifugally away from the neck with the wefts overlapping each other and extending over the bolus with the curled shafts 45 of the wefts substantially curled around the curved bottom surface 17 of the bolus 24, preserving the one directional curl of the wig or hair piece. The wefts are retained in the cavity by the plug base 21 which bears against the curved bottom 17 of the bolus 24.

Figure 3:
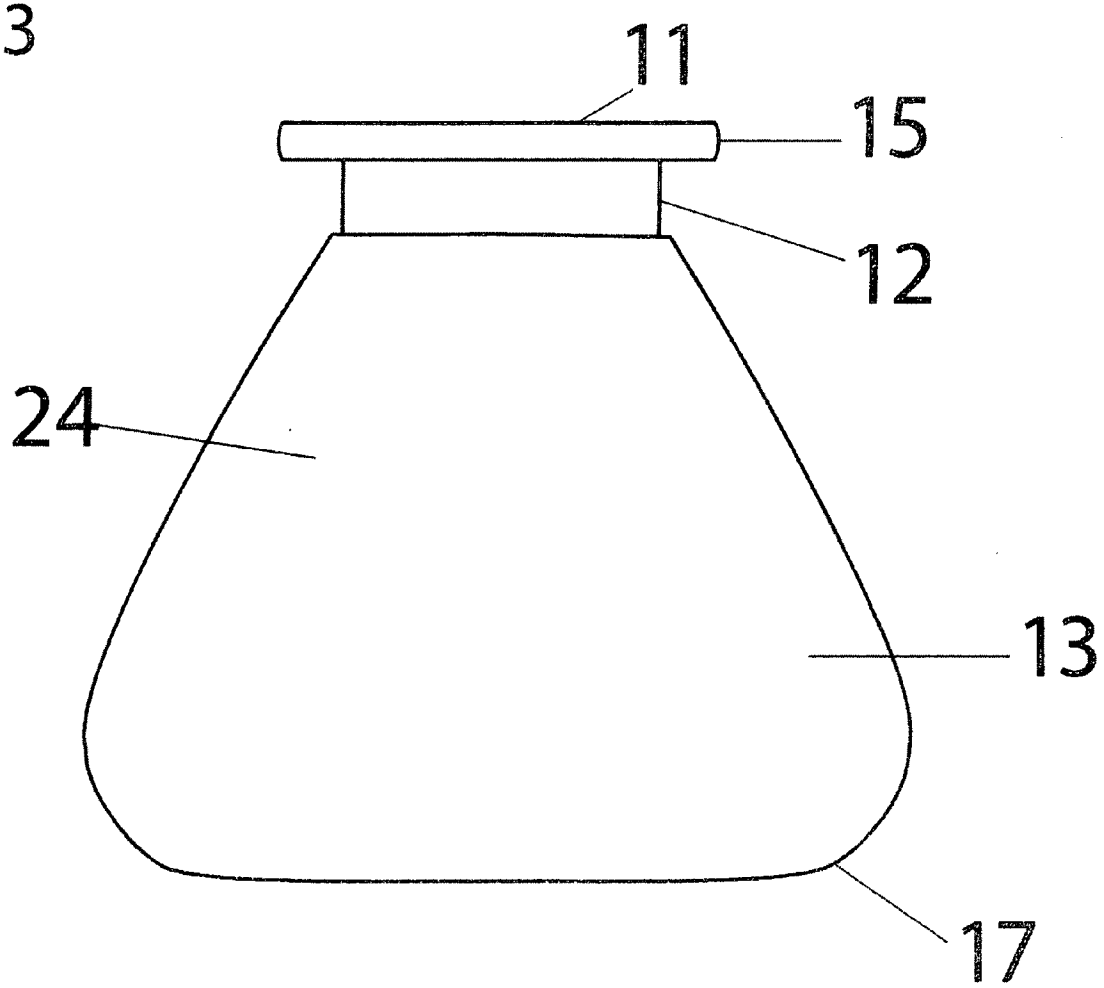
FIG. 3 is a side view of an embodiment form body.

FIG. 3 is a side view of an embodiment form body. Visible in FIG. 3 is form body 13, the disk-shaped body top 11, the flange 15 on the side of the top, the body neck 12 connecting the top and the jar-shaped bolus 24.

Figure 4:
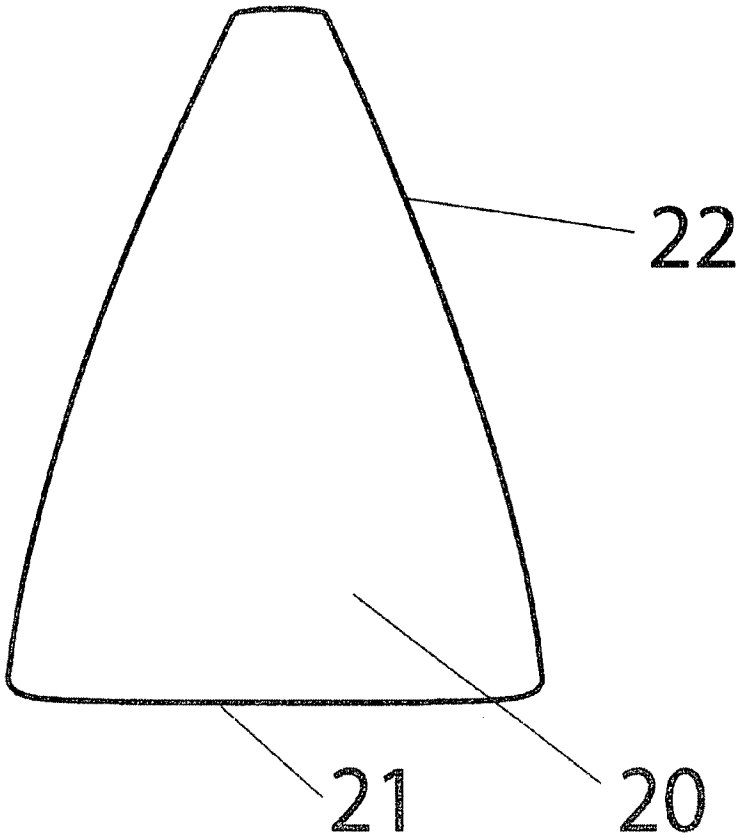
FIG. 4 is a side view of an embodiment form plug.

FIG. 4 is a side view of an embodiment form plug. Visible in FIG. 4 is a form plug 20 with plug base 21, and plug side 22. Embodiment plugs have the shape of a truncated cone. Embodiment plugs are sized to allow an annulus (23 in FIG. 2) between the plug side 22 and the internal side of the cavity of the form base.

Figure 5:
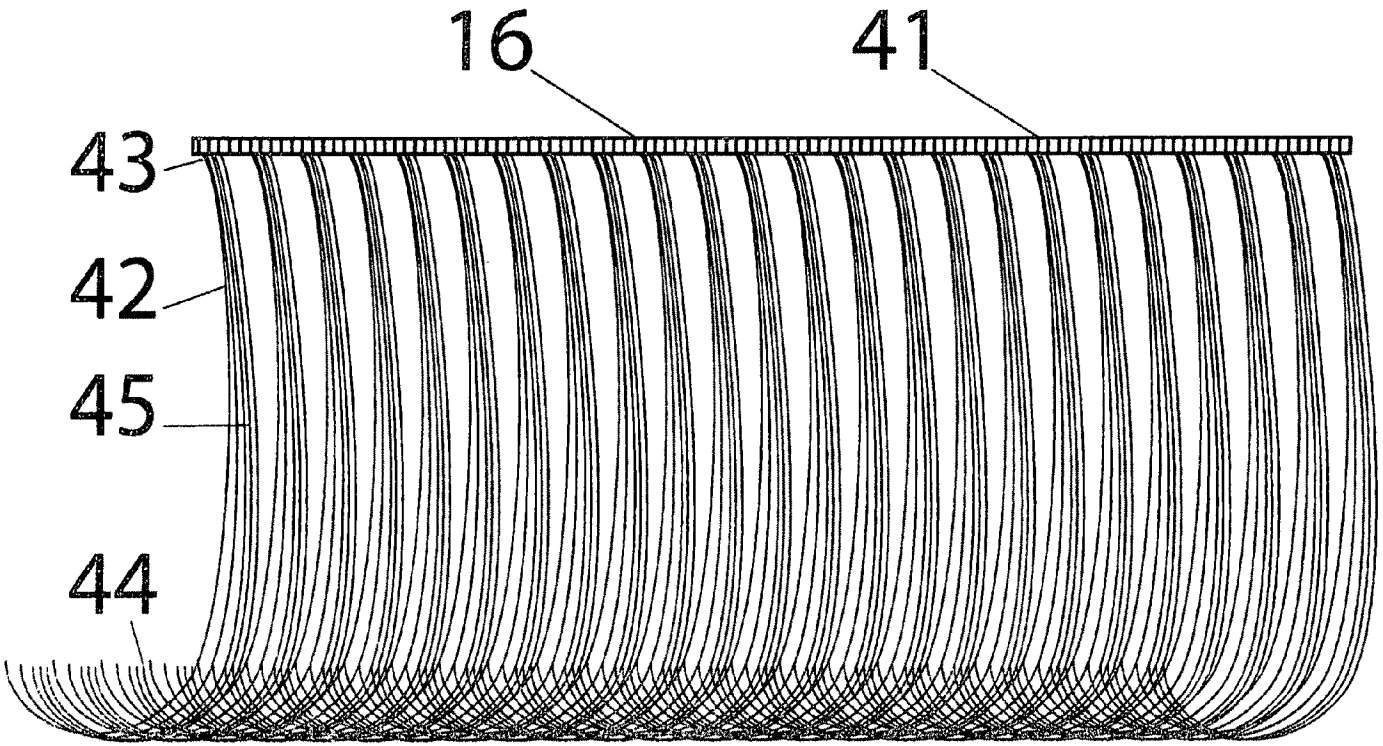
FIG. 5 is a side view of a portion of an embodiment hair extension.

FIG. 5 is a side view of a portion of an embodiment wig or hair piece 16. Visible in FIG. 5 is a weft track 41, weft or strands of hair 42, the wefts comprised of a root end 43 which is attached to the weft track 41, and free tip end 44, and a curved weft shaft 45.

Visible in FIG. 5 is a portion of a wig or hair piece 16. This wig comprises an elongated band or weft track 41 and wefts or strands of hair 42 are fixedly attached to the band or weft track by the root end 43. In embodiments the band is about 10-12 feet in length. In embodiments the band is 12 to 24 inches in length. In embodiments there are about 18 wefts per inch of band. In embodiments there are about 12-24 wefts per inch of band. In embodiments wefts of hair consist of 10 to 50 strands of hair. In embodiments the lenth of hair is about 8 inches. In embodiments the lenth of hair is about 3 to 12 inches long. In embodiments the shafts 45 of the wefts, are parallel and are curled, with the curl of all hair strands substantially parallel to each other, termed a "one directional curl." The free ends of the wefts are tip ends 44.

Embodiment forms are manufactured of any suitable strong, resilient material. Suitable materials include wood, foamed plastics, some examples of which are polystyrene, polybutadiene, polyurethane, and polyethylene. Other embodiments include forms manufactured of cardboard or papier-mache. Other embodiment forms are manufactured of flexible plastic or rubber, are bag-like in structure, and are filled with a fluid such as air or water.

Although the example embodiment disclosed here has a form body manufactured in a single piece combining the top, neck and bolus, it is specifically contemplated that other embodiments in which the components of the form body are manufactured in two or more pieces and then combined are included in this disclosure.

In embodiment forms the height of the form body is about 4¾ inches, the height of the top flange is about ⅜ inch and the width of the top is about 2⅞ inch, the height of the neck is about ¾ inch and the width of the neck is about 1½ inch. The height of the bolus is about 3¾ inches and the width of the bolus is about 4½ inches. The cavity in the bottom of the bolus has a width of about 2½ inches and a height of about 3 inches.

In embodiment forms the height of the plug is about 2⅝ inches and the width of the plug base is about 2⅜ inches.

The dimensions of embodiments vary accordingly to the size and type of wigs, hairpieces, and hair extensions they are designed to hold and protect. Embodiment form body heights range from about 3 inches to about 8 inches, with other form body dimensions varied in proportion.

Although in FIG. 2 the position of the weft track is shown as wrapped about the neck with overlap of the layers of weft tract, other orientations of the weft track on the neck are specifically contemplated. In embodiments the weft tracks of hair extensions are wrapped about the entire surface of the neck, with little or no overlap of one weft track with another. In embodiments multiple hair extensions with lengths of about 2 feet are secured to the form, with the weft track of each individual extension overlapping itself only. In embodiments the entire surface of the neck is covered with weft tracks.

Although embodiment wigs and hair pieces have wefts of hair comprised of human hair, the use of wigs and hair pieces with wefts of hair comprised of synthetic hair or animal hair is specifically contemplated. It should be noted that this form is especially useful for human hair wigs and hair pieces because human hairs has a tendency to lose its curl in the absence of suitable storage, such as is provided by embodiments of the present disclosure.

The process of placing a wig, hair piece or hair extension having curved parallel weft strands attached to a weft track on a form comprises the steps:

a. obtaining a form comprising a body comprising a disk-shaped body top, a neck, a jar-shaped bolus, the neck connected to a bottom of the disk-shaped body top at one end and the neck connected to the top of the bolus at the other end, the bolus having a cone-shaped cavity in the bottom of the bolus, and a plug having the shape of a truncated cone, the plug sized to fit into the cavity with an annulus between the sides of the plug and the surface of the cavity, b. attaching the wig, hair piece or hair extension weft track to the neck, c. wrapping the weft track about the neck so that the curved parallel weft strands cover the surface of the bolus, d. inserting the free ends of the weft strands into the cavity, and e. inserting the plug into the cavity.

The process further comprises the optional step after inserting the plug into the cavity, enclosing the form and wig, hair piece or hair extension with a hairnet.

Embodiment processes attach the weft track to the neck using a straight pin, although other embodiments are contemplated using other conventional methods of fastening, such as staples, glue, or clips.

Although embodiments of the form are described in this application in connection with a wig comprised of an elongated band or weft track with attached wefts, it is specifically contemplated that other types of wigs also can be used in connection with the disclosed forms with preservation of the original style and order and one directional curl.

Embodiments of the disclosed forms are used both for the packaging and display of wigs and hair pieces for sale by manufacturers, as well as for use by consumers to conveniently store and preserve the order, style and condition of wigs and hair pieces when not in use, especially for preservation of the curl on the strands of hair. Embodiment forms allow convenient and inexpensive storing and displaying wigs or hair pieces while requiring a minimal amount of space.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A combination comprising:

a wig, hair piece, or hair extension; and a form for holding and storing the wig, hair piece, or hair extension, the form comprising:

a body comprising:

a body top, a neck, and a bolus, the neck connected to a bottom of the body top at one end and the neck connected to a top of the bolus at the other end, the bolus having a central cavity in a curved bottom of the bolus, and a plug configured to be removably received into the central cavity with an annulus between the sides of the plug and an interior surface of the central cavity, wherein:

the wig, hair piece, or hair extension is attached to the form, a plurality of strands of hair from the wig, hair piece, or hair extension substantially cover an outer surface of the bolus, free tip ends of the strands of hair curl about the curved bottom of the bolus, the free tip ends of the strands of hair are received within the central cavity, and the free tip ends of the strands of hair are retained within the central cavity by the plug, wherein the plug and the curved bottom are configured to preserve the one directional curl of the wig, hair piece, or hair extension.

2. The combination of claim 1, wherein the form comprises at least one of foamed polystyrene, polybutadiene, polyurethane, and polyethylene, cardboard or papier-mache, flexible plastic, rubber, or wood.

3. The combination of claim 1, wherein the form is manufactured of foamed polystyrene.

4. A process of placing a wig, hair piece or hair extension having curved parallel weft strands attached to a weft track on a form, comprising the steps of:

a. obtaining a form comprising:

a body comprising a disk-shaped body top, a neck, and a bolus, wherein the neck is connected to a bottom of the disk-shaped body top at one end and the neck is connected to a top of the bolus at the other end, and wherein the bolus includes a cone-shaped cavity in a bottom of the bolus, and a plug having the shape of a truncated cone, the plug sized to fit into the cavity with an annulus between the sides of the plug and an interior surface of the cavity, b. attaching the wig, hair piece or hair extension weft track to the neck, c. wrapping the weft track about the neck so that the curved parallel weft strands cover a surface of the bolus, d. inserting the free ends of the weft strands into the cavity, and e. inserting the plug into the cavity.

5. The process of claim 4 further comprising the step after step e.:

f. enclosing the form and wig, hair piece or hair extension with a hairnet.

6. The process of claim 4 wherein the weft track is attached to the neck by a pin, glue, or a clip.

7. The combination of claim 1, wherein a diameter of the top of the bolus is smaller than a diameter of the bottom of the bolus.

8. The combination of claim 1, wherein the wig, hair piece, or hair extension includes strands of hair attached to a weft track, wherein the weft track is wrapped about and attached to the neck.

9. The combination of claim 1, further comprising:

a hairnet enclosing the form and the wig, hair piece, or hair extension.

10. A combination comprising:

a wig, hair piece, or hair extension; and a form for holding and storing the wig, hair piece, or hair extension, the form comprising:

a main body including:

a neck portion; and a frustoconical portion having an outer surface extending between a first end and a second end, wherein the first end is coupled to the neck portion, and wherein the second end has a curved bottom including a central cavity; and a plug configured to be removably received in the central cavity to define an annular space between an outer surface of the plug and an inner surface of the central cavity, wherein:

the wig, hair piece, or hair extension is attached to the form, a plurality of strands of hair from the wig, hair piece, or hair extension substantially cover the outer surface of the frustoconical portion, free tip ends of the strands of hair curl about the curved bottom, the free tip ends of the strands of hair are received within the central cavity, and the tip ends of the strands of hair are retained within the central cavity by the plug, wherein the plug and the curved bottom are configured to preserve the one directional curl of the wig, hair piece, or hair extension.

11. The combination of claim 10, further comprising a flange coupled to the neck portion opposite the first end of the frustoconical portion.

12. The combination of claim 10, wherein a diameter of the first end of the frustoconical portion is smaller than a diameter of the second end of the frustoconical portion.

13. The combination of claim 10 wherein the wig, hair piece, or hair extension includes strands of hair attached to a strip, wherein the strip is attached to the neck portion.

14. The combination of claim 1, further comprising:

a hairnet enclosing the form and the wig, hair piece, or hair extension.

15. The combination of claim 1, wherein the body top is disk-shaped.

16. The combination of claim 1, wherein the central cavity is cone-shaped.

17. The combination of claim 1, wherein the plug has a shape of a truncated cone.

18. The combination of claim 10, wherein the plug is substantially conical.

19. The combination of claim 1, wherein the plug is free-standing.

* * * * *